US008242418B2

(12) United States Patent
Kuo

(10) Patent No.: US 8,242,418 B2
(45) Date of Patent: Aug. 14, 2012

(54) GOLF BALL BAG WITH TEMPERATURE CONTROLLING DEVICE

(76) Inventor: KuangHung Kuo, Taipei (TW)

( * ) Notice: Subject to any disclaimer, the term of this patent is extended or adjusted under 35 U.S.C. 154(b) by 885 days.

(21) Appl. No.: 12/290,516

(22) Filed: Oct. 30, 2008

(65) Prior Publication Data

US 2009/0321290 A1 Dec. 31, 2009

Related U.S. Application Data

(63) Continuation-in-part of application No. 12/215,554, filed on Jun. 27, 2008.

(51) Int. Cl.
*H05B 1/02* (2006.01)

(52) U.S. Cl. ..... 219/494; 219/506; 219/507; 219/535; 219/521

(58) Field of Classification Search ..... 219/494, 219/497, 505, 507–509, 521, 535
See application file for complete search history.

(56) References Cited

U.S. PATENT DOCUMENTS

| | | | | | |
|---|---|---|---|---|---|
| 2,272,340 | A * | 2/1942 | Hampton | 126/263.05 |
| 3,707,279 | A * | 12/1972 | Kaiser | 432/88 |
| 3,746,837 | A * | 7/1973 | Frey et al. | 219/387 |
| 4,967,062 | A * | 10/1990 | Cohen | 219/521 |
| 5,062,528 | A * | 11/1991 | Whitaker, Jr. | 206/315.3 |
| 5,860,415 | A * | 1/1999 | Waters | 126/680 |
| 5,998,771 | A * | 12/1999 | Mariano et al. | 219/528 |
| 7,230,212 | B1 * | 6/2007 | Sarkisian et al. | 219/521 |
| 2008/0251400 | A1 * | 10/2008 | Ulrich | 206/315.9 |

* cited by examiner

*Primary Examiner* — Mark Paschall
(74) *Attorney, Agent, or Firm* — Raymond Y. Chan; David and Raymond Patent Firm

(57) ABSTRACT

A golf ball bag includes a main housing for receiving one or more golf balls in the receiving cavity, and a temperature controlling device. The temperature controlling device includes a heating plate disposed within the receiving cavity to substantially align with the hitting surface of the golf balls, and a power source supported by the main housing to electrically connect with the heating plate. When the power source is activated, the heating plate is arranged to generate heat and to transfer to the hitting surfaces of the golf balls so as to heat up and maintain the hitting surfaces of the golf balls at an elevated temperature for achieving an optimal performance.

15 Claims, 13 Drawing Sheets

GOLF BALL BAG WITH TEMPERATURE CONTROLLING DEVICE

CROSS REFERENCE OF RELATED APPLICATION

This is a Continuation-In-Part of a non-provisional application having an application Ser. No. 12/215,554 and a filing date of Jun. 27, 2008.

BACKGROUND OF THE PRESENT INVENTION

1. Field of Invention

The present invention relates to a golf ball bag, and more particularly to a golf ball bag for a golf ball comprising a temperature controlling device adapted to maintain the temperature of the golf ball at a certain desired temperature within the golf ball bag.

2. Description of Related Arts

Golfing is an extremely popular sport nowadays. The golf clubs and other equipments are expensive, thus cares and maintenances are required while using and storing these equipments. The golf clubs are inserted into the golf club head covers for protection while not in used or when they are stored at home or inside a car. The hitting surface of the head of the golf clubs is very critical for performance, thus the golf clubs are inserted into the golf club head cover for protection. During a regular golf games, players are required to travel along the golf courses for approximately 4 to 5 hours and the golf clubs are stored safely. Conventional golf club head covers come in many shapes and sizes and provide sufficient protections for different golf clubs.

It is a proven fact that the temperature of the hitting surface of the golf club provides extra driving distance for the drive. This result is obvious when using the driver for hitting long distance drive. The best result is to keep the hitting surface of the driver within a temperature range of 43° C. to 55° C. While conventional golf club head covers provide physical protections for the golf clubs, they do not provide any heating function for the hitting surface of the golf club especially in a cold environment.

Furthermore, the temperature of the hitting surface of the golf ball also has a great influence of the golf sport performance, people are used to ignore the temperature of the golf ball, there exits a great need for a simple way for carrying the golf ball and providing the accurate temperature to the hitting surface of the golf ball.

SUMMARY OF THE PRESENT INVENTION

A main object of the present invention is to provide a golf ball carrier for a golf ball which comprises a temperature controlling device for maintaining the golf ball at a predetermined temperature so as to allow the golf ball to achieve the best performance for being hit by a golf club.

Another object of the present invention is to provide a golf ball bag for a golf club comprising a temperature controlling device for heating up a hitting surface of the golf club at an elevated temperature, wherein the golf club head cover is readily portable so that the user is able to maintain the golf club at the optimal elevated temperature in a wide variety of circumstances. In other words, the present invention is capable of promoting widespread applications.

Another object of the present invention is to provide a golf ball bag for a golf ball which has a simple electrical structure for providing a heat source to control the temperature so that the golf ball is in its best condition for being hit by a golf club.

Another object of the present invention is to provide a golf ball bag for a golf ball which does not involve complicated mechanical structure so as to minimize the manufacture cost of the present invention.

Another object of the present invention is to provide a golf club head cover for a golf club which comprises a temperature controlling device for maintaining the golf club head at a predetermined temperature so as to allow the golf club to achieve the best performance for a hitting a golf ball.

Another object of the present invention is to provide a golf club head cover for a golf club comprising a temperature controlling device for heating up a hitting surface of the golf club at an elevated temperature, wherein the golf club head cover is readily portable so that the user is able to maintain the golf club at the optimal elevated temperature in a wide variety of circumstances. In other words, the present invention is capable of promoting widespread applications.

Another object of the present invention is to provide a golf club head cover for a golf club which has a simple electrical structure for providing a heat source to control the temperature so that the golf club is in its best condition for hitting a golf ball.

Another object of the present invention is to provide a golf club head cover for a golf club which does not involve complicated mechanical structure so as to minimize the manufacture cost of the present invention.

Accordingly, in order to accomplish the above objects, the present invention provides a golf club head cover for a golf club comprising a golf club head having a hitting surface for hitting a golf ball, comprising:

a main housing having a cavity and a heating pocket provided within the cavity, wherein the golf club head is adapted to be fittedly disposed within the cavity to align the hitting surface with the heating pocket; and a temperature controlling device, which comprises:

a heating plate disposed within the heating pocket to substantially align with the hitting surface of the golf club head; and a power source supported by the golf club head cover to electrically connect with the heating plate, wherein when the power source is activated, the heating plate is arranged to be heated up by the power source, wherein heat generated by the heating plate is transferred to the hitting surface of the golf club head through the heating pocket so as to heat up and maintain the hitting surface to an elevated temperature for achieving an optimal performance when the hitting surface hits a golf ball.

Accordingly, in order to accomplish the above objects, the present invention also provides a golf ball bag which comprises a main housing for receiving one or more golf balls in the receiving cavity, and a temperature controlling device.

The temperature controlling device comprises a heating plate disposed within the receiving cavity to substantially align with the hitting surface of the golf balls, and a power source supported by the main housing to electrically connect with the heating plate, wherein when the power source is activated, the heating plate is arranged to be heated up by the power source, wherein heat generated by the heating plate is transferred to the hitting surface of the golf ball through the heating pocket so as to heat up and maintain the hitting surface of the golf ball to an elevated temperature for achieving an optimal performance when the hitting surface hit by a golf club.

These and other objectives, features, and advantages of the present invention will become apparent from the following detailed description, the accompanying drawings, and the appended claims.

DETAILED DESCRIPTION OF THE PREFERRED DESCRIPTION

Figure 1:
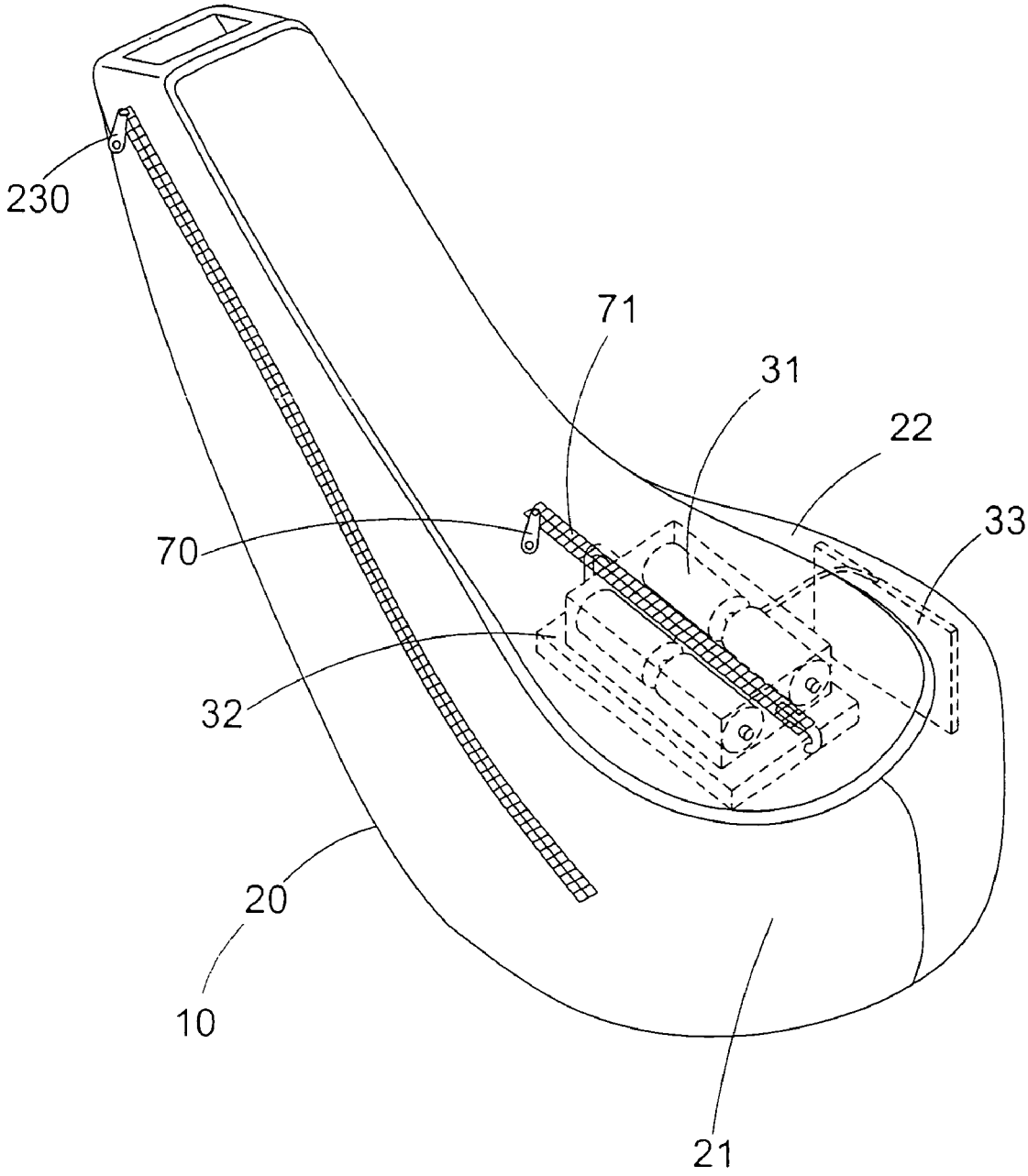
FIG. 1 is a perspective view of the golf club head cover according to a preferred embodiment of the present invention.

Referring to FIG. 1 to FIG. 8 of the drawings, a golf club head cover 10 for a golf club 50 comprising a golf club head having a hitting surface 51 for hitting a golf ball according to a preferred embodiment of the present invention is illustrated, in which the golf club head cover 10 comprises a main housing 20 and a temperature controlling device 30.

The main housing 20 has a cavity 21 and a heating pocket 24 provided within the cavity 21, wherein the golf club head is adapted to be fittedly disposed within the cavity 21 to align the hitting surface 51 with the heating pocket 24.

The temperature controlling device 30 comprises a heating device which comprises a heating plate 33 disposed within the heating pocket 24 to substantially align with the hitting surface 51 of the golf club head, and a power source 31 supported by the golf club head cover 10 to electrically connect with the heating plate 33, wherein when the power source 31 is activated, the heating plate 33 is arranged to be heated up by the power source 31, wherein the heat generated by the heating plate 33 is transferred to the hitting surface 51 of the golf club head through the heating pocket 24 so as to heat up and maintain the hitting surface 51 to an predetermined elevated temperature for achieving an optimal performance when the hitting surface 51 hits a golf ball.

Figure 3:
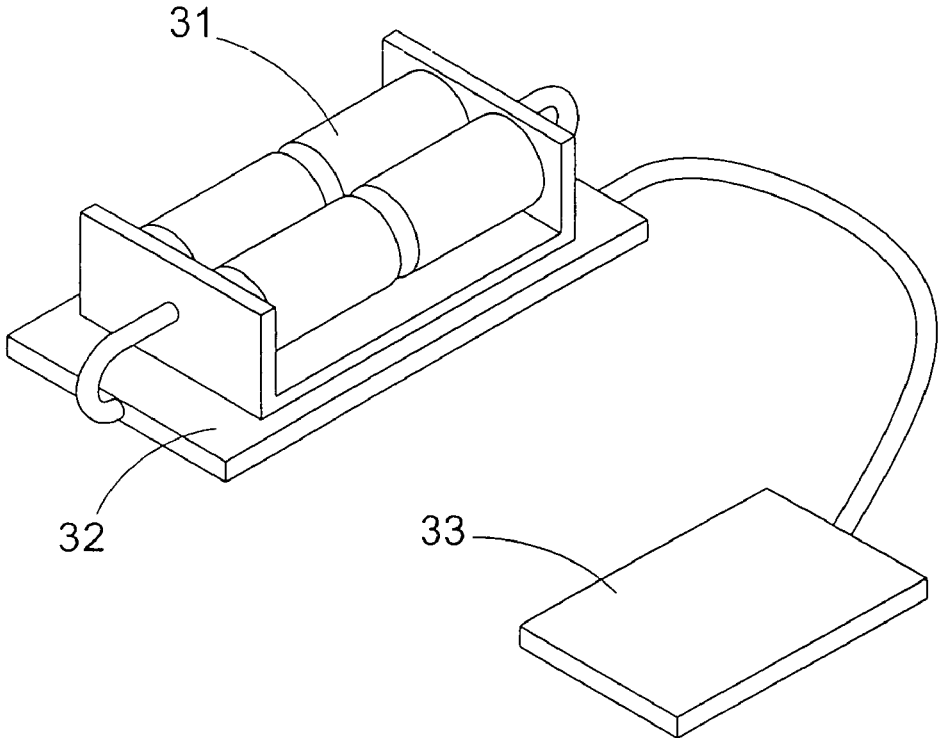
FIG. 3 is a perspective view of the temperature controlling device according to the above preferred embodiment of the present invention.
Figure 4:
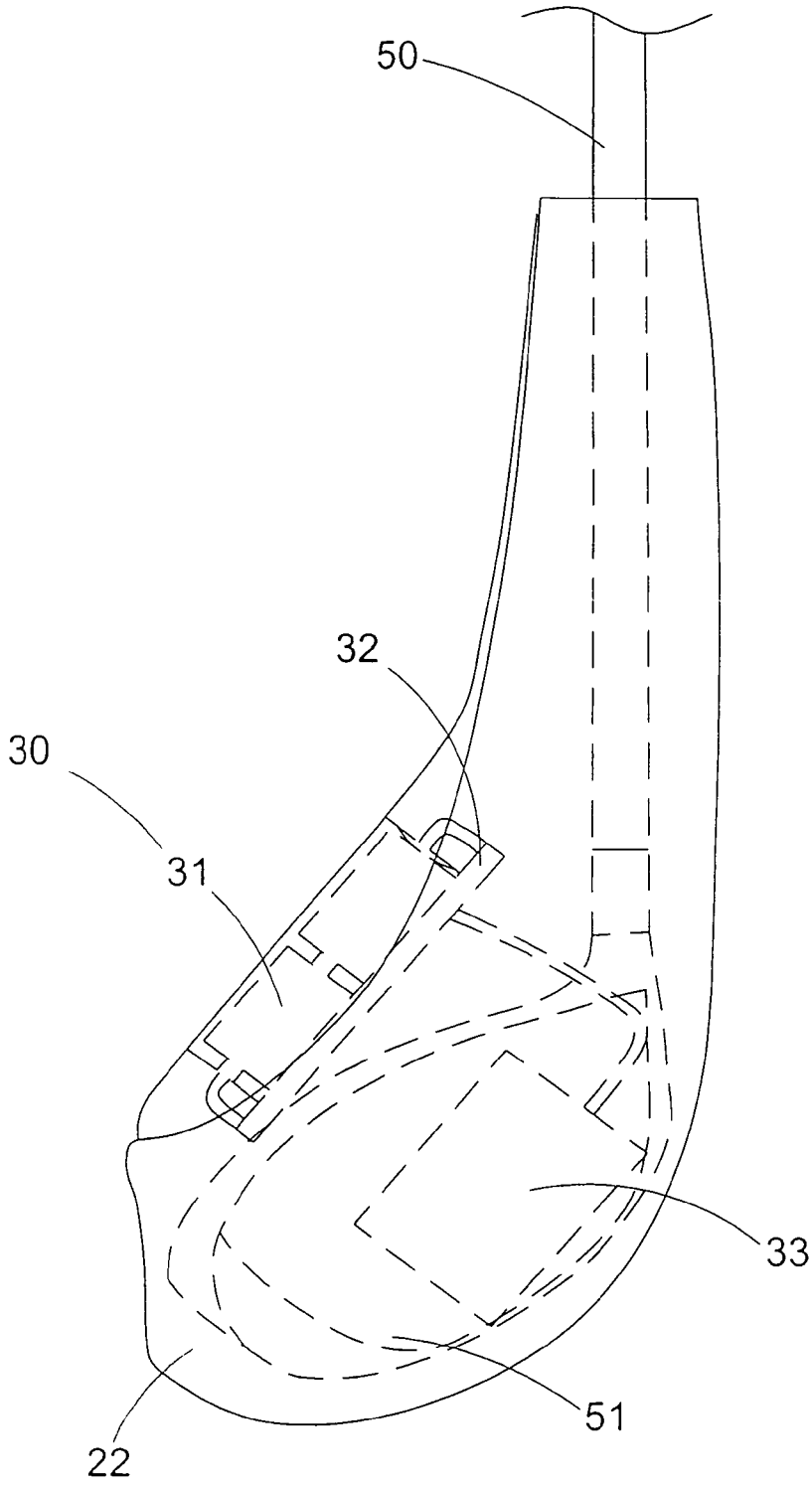
FIG. 4 is another schematic diagram of the golf club head cover according to the above preferred embodiment of the present invention.

According to the preferred embodiment of the present invention, the main housing 20, having a top portion 26 and a bottom portion 27 defining the receiving cavity 21 therewithin, is made of soft padding materials surrounding an outside of the main housing 20 which creates the cavity 21 for inserting an object (such as the golf club 50) which requires heating or cooling. As shown in FIG. 4 of the drawings, a top portion of a golf club 50 is inserted into the cavity 21 of the golf club head cover 10 for providing protection. The main housing 20 further has a heating side 22 and an opening side 23. As shown in FIG. 3 of the drawings, when the golf club 50 is inserted into the cavity 21 of the golf club head cover 10, a hitting surface 51 of the golf club 50 aligns with the heating side 22 of the main housing 20 of the golf club head cover 10.

Figure 6:
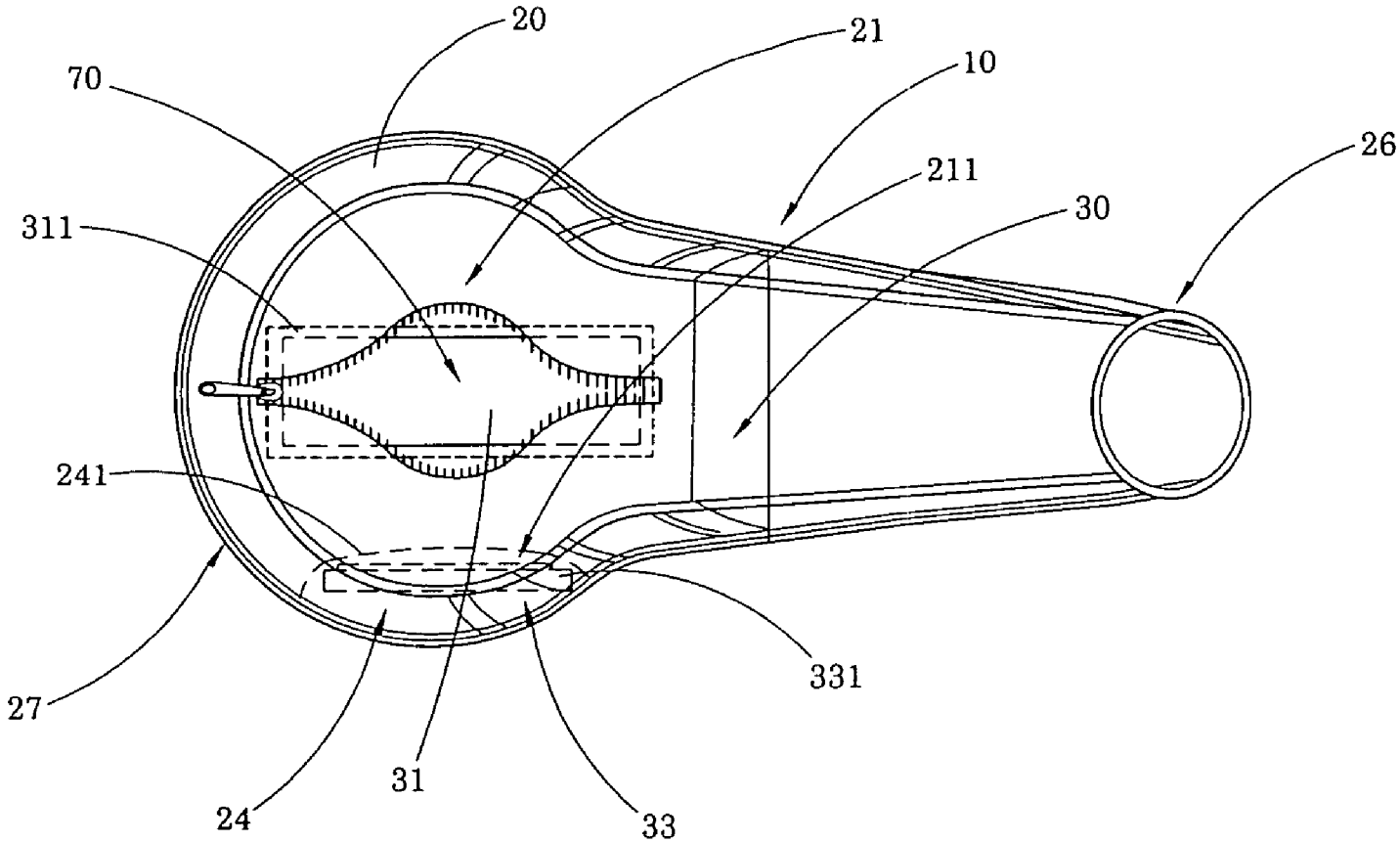
FIG. 6 is a top view of the golf club head cover according to the above preferred embodiment of the present invention.
Figure 7:
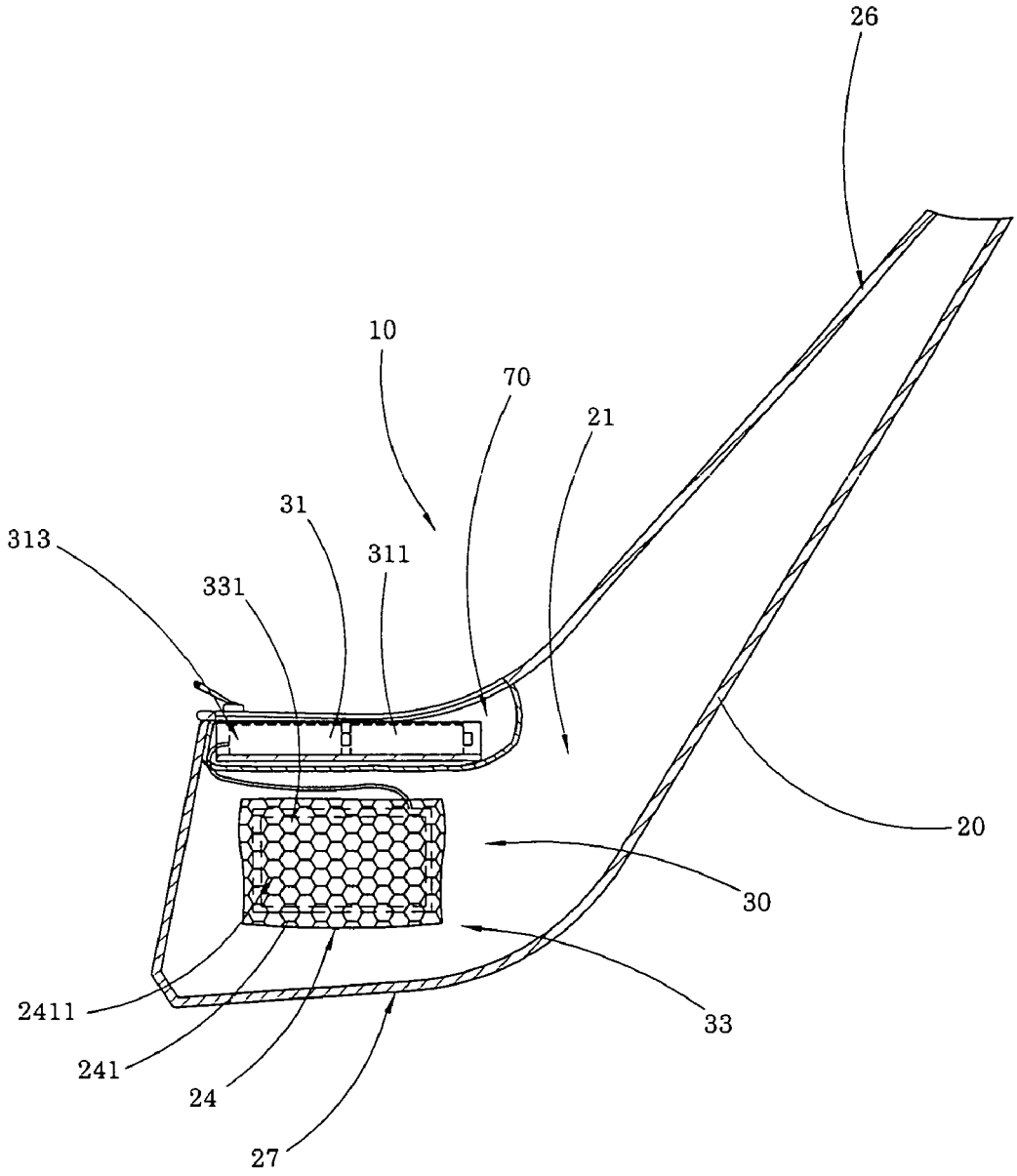
FIG. 7 is a side view of the golf club head cover according to the above preferred embodiment of the present invention.
Figure 8:
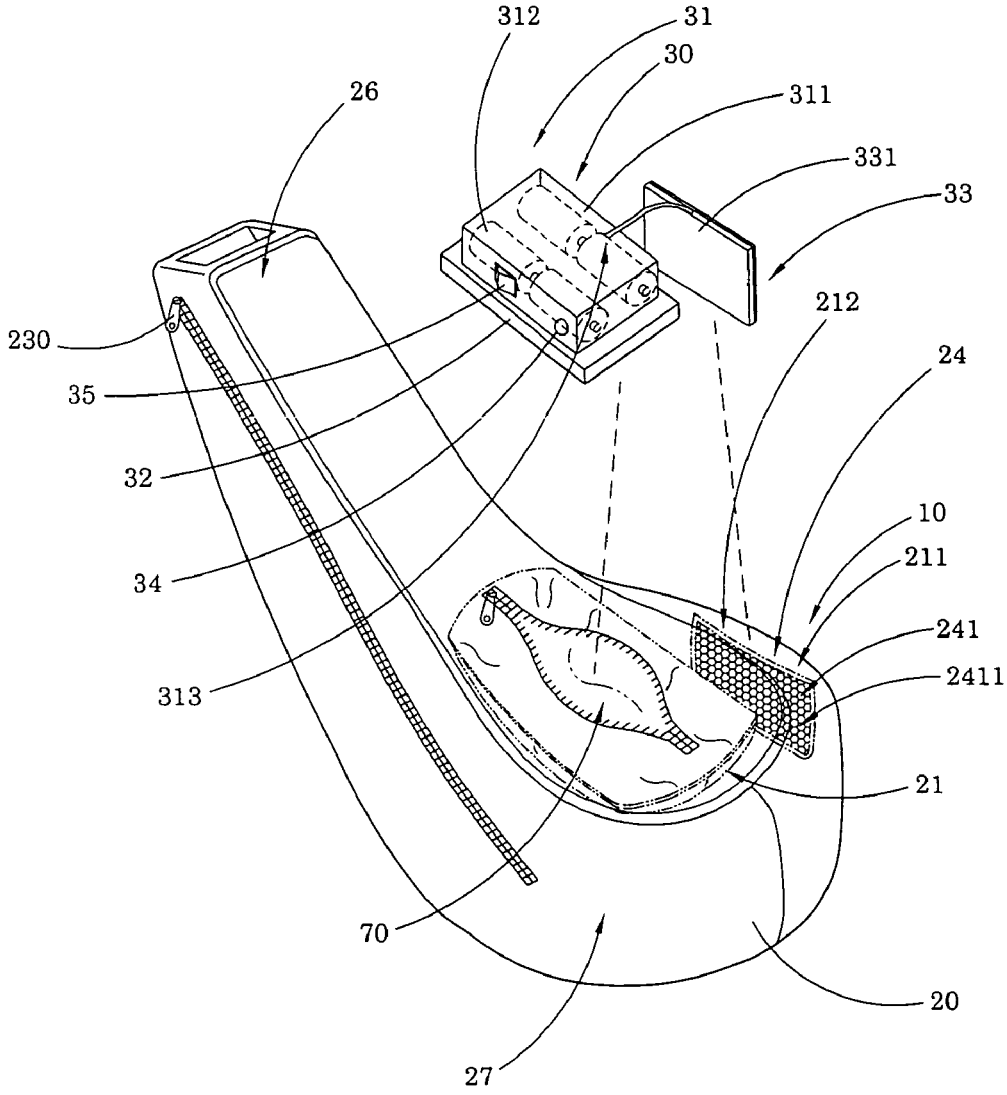
FIG. 8 is an exploded perspective view of the golf club head cover according to the above preferred embodiment of the present invention.

The heating pocket 24 is disposed in the receiving cavity 21 of the main housing 20, and comprises a pocket holder 241 attached to an inner surface of the receiving cavity 21 at a position aligning with the hitting surface 51 to define a heating cavity 211 for holding the hitting plate 33, and a pocket opening 212 communicating the heating cavity 211 and the receiving cavity 21. It is worth mentioning that the pocket opening 212 may be selectively sealed for blocking unwanted physical access to the heating cavity 211 from the receiving cavity 21. As shown in FIG. 6 to FIG. 7 of the drawings, the pocket holder 241 comprises a flexible fabric preferably having a plurality ventilating holes 2411 formed thereon for thermally communicating the heating cavity 24 with the receiving cavity 21.

Figure 5:
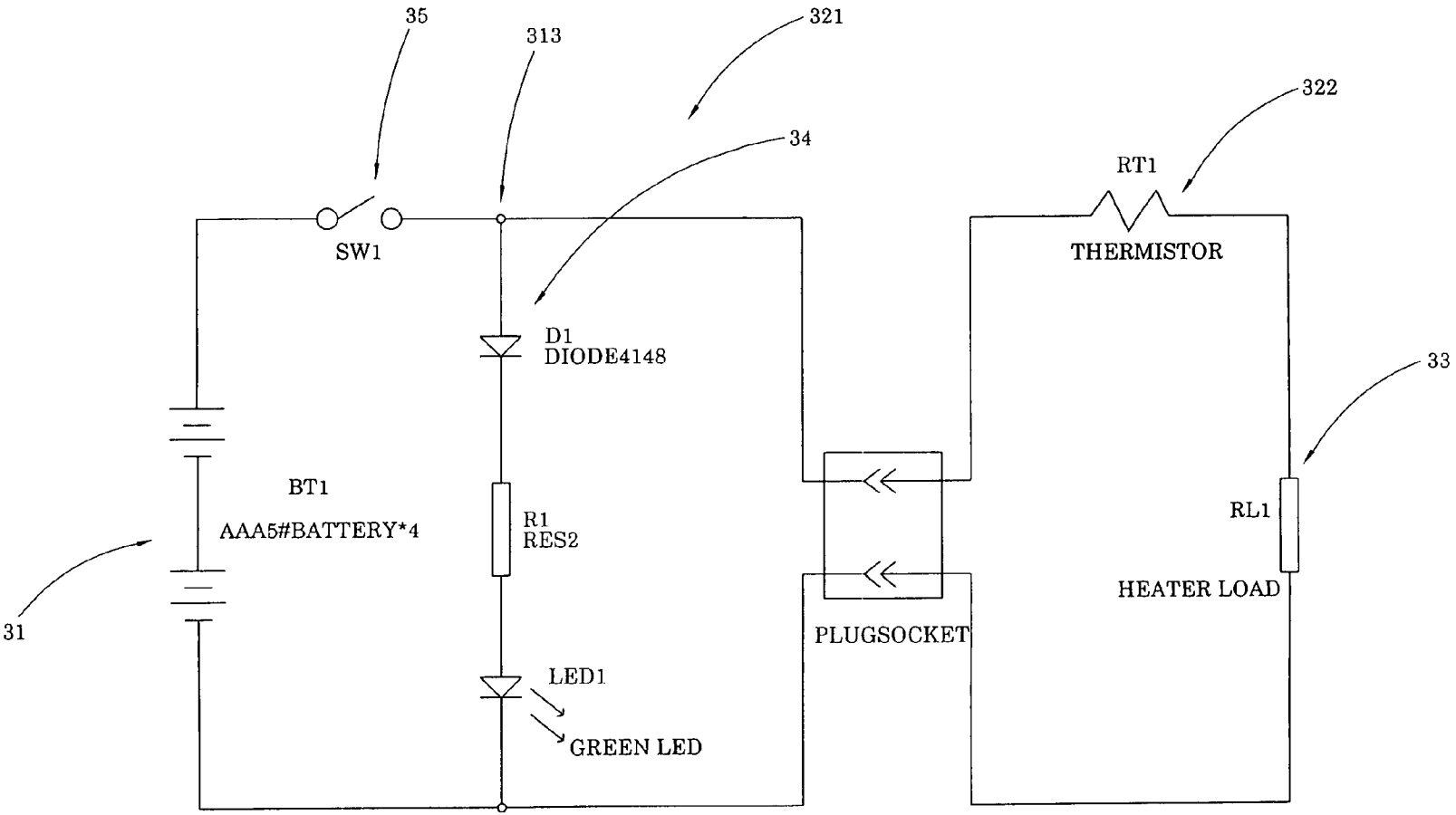
FIG. 5 is a circuit diagram of the golf club head cover according to the above preferred embodiment of the present invention.

The temperature controlling device 30 further comprises a circuit board 32 for controlling an operation for the heating plate 33 as powered by the power source 31. More specifically, the power source 31, the circuit board 32, and the heating plate 33 are all electrically connected with respective to each other as shown in FIG. 3 and FIG. 5 of the drawings. The power source 31 of the temperature controlling device 30 comprises a plurality of batteries 312 providing electrical power for operating the heating plate 33 for a period of four to five hours. The power source 30 could also be connected to any external power source for providing the electrical power.

The circuit board 32 comprises a power circuitry 321 to provide a controlled electrical signal for the heating plate 33 so that it can be activated for heating the hitting surface 51 of the golf club head. The circuit board 32 further comprises a temperature detecting device 322 for detecting a current temperature of the hitting surface 51 of the golf club 50 such that the power circuitry 321 is capable of determining if the hitting surface 51 requires heating or not for promptly and accurately responding to a temperature deficiency of the hitting surface 51 (i.e. the deficiency between the current temperature and the elevated temperature). A best temperature range for the hitting surface 51 of the golf club 50 is 43° C. to 55° C. So for example, when the temperature detecting device 322 of the circuit board 32 detects that the temperature of the hitting surface 51 is 25° C. (room temperature), the power circuitry 321 of the circuit board 32 will activate the heating plate 33 to heat up the hitting surface 51 of the golf club 50. According to the preferred embodiment of the present invention, it takes approximately 14 minutes for the initial heating to reach 55° C. from 25° C. (room temperature). As mentioned above, the heating plate 33 is disposed firmly inside the heating pocket 24 within the main housing 20. Moreover, the temperature controlling device 30 further comprises a control switch 35 supported by the main housing 20 to electrically connect with the circuit board 32 for selectively activating the heating plate 33 in a controlled manner. Thus, a user is able to turn on or off the heating plate 33 by switching the control switch 35. Note that the position of the control switch 35 can vary depending on the circumstances in which the present invention is used and manufactured. For example, the control switch 35 can be provided directly on the circuit board 32, or it can be electrically extended to provide on the main housing 20 out of the receiving cavity 21. Similarly, the control switch 35 can also be extended from the circuit board 32 to be received within the receiving cavity 21 for better protection of the control switch 35. Note that the temperature detecting device 322 can be a conventional temperature sensor, such as a thermistor, for detecting the temperature of the hitting surface 51.

The power source 31 comprises a battery holder for holding a replaceable battery 312 in position, and a terminal 313 extended from the battery holder to the heating device for electrically connecting the replaceable battery 312 with the heating device when the replaceable battery 312 is held at the battery holder.

According to the preferred embodiment of the present invention, the power source 31 comprises a battery rack 311, having a plurality of battery terminals, supported within the receiving cavity 21 to electrically connect with the circuit board 32 and the heating plate 33, and a plurality of the replaceable batteries 312 replaceably installed at the battery rack 311 for providing electricity to the circuit board 32 and the heating plate 33. It is worth mentioning that the batteries 312 can be embodied as regular dry cells, or rechargeable batteries which are capable of supplying electrical power to heat up the heating plate 33 as controlled by the circuit board 32. As shown in FIGS. 1-8 of the drawings, the battery rack 311 is received within the receiving cavity 21 and is spacedly apart from the heat plate 33 so that a size of the heating pocket 24 can be minimized to facilitate accurate alignment with the hitting surface 51 when the golf club 50 or at least the golf club head is contained within the receiving cavity.

Moreover, the temperature controlling device 30 further comprises a heating indicator 34 provided on the battery rack 311 of the power source 31 for indicating a heating status of the hitting surface 51. For example, when the power source 31 is heating up the hitting surface 51 (i.e. the temperature of the heating plate 33 is increasing), a predetermined color is indicated on the heating indicator 34 for informing the user that the temperature controlling device 30 has been activated and is heating up the hitting surface 51 through the heating plate 33. According to the preferred embodiment of the present invention, the heating indicator 34 is embodied as a LED adapted to generate illumination to indicator a heating status of the heating plate 33. Furthermore, the heating plate 33 comprises a silicon or silver heat transfer panel 331 wherein heat is transferred to the hitting surface 51 through the silicon or silver heat transfer panel 331.

As shown in FIG. 1 of the drawings, the opening side 23 of the main housing 10 further comprises a zipper 230 for opening and closing the cavity 21 for inserting the object that requires heating. According to the preferred embodiment of the present invention, when the zipper 230 is opened, it enlarges the cavity 21 such that the golf club 50 can be easily inserted inside the golf club head cover 10. After the insertion, the zipper 230 is closed thus allowing the golf club head cover 10 to completely surround and protect the top portion of the golf club 50. The soft padding materials of the main housing 10 prevent the top portion of the golf club 50 to be damaged from physical impacts.

Figure 2:
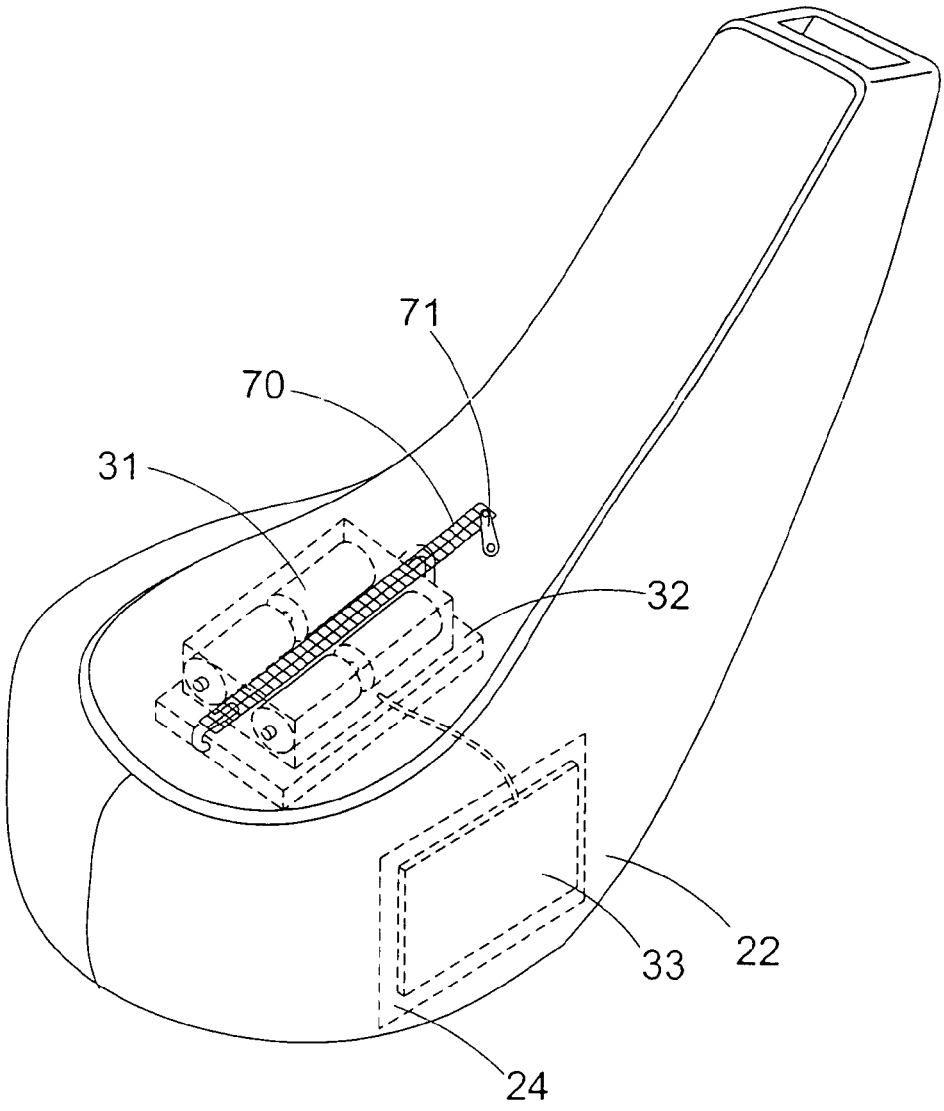
FIG. 2 is a schematic diagram of a golf club head cover according to the above preferred embodiment of the present invention.

According to the preferred embodiment of the present invention as shown in FIG. 1 and FIG. 2 of the drawings, the outside of the main housing 10 further comprises a battery pocket 70 to contain the batteries of the power source 31 and the circuit board 32 therewithin. The battery pocket 70 further comprises a zipper 71 to open and close the battery pocket 70 for inserting the power source 31 and the circuit board 32.

Figure 9:
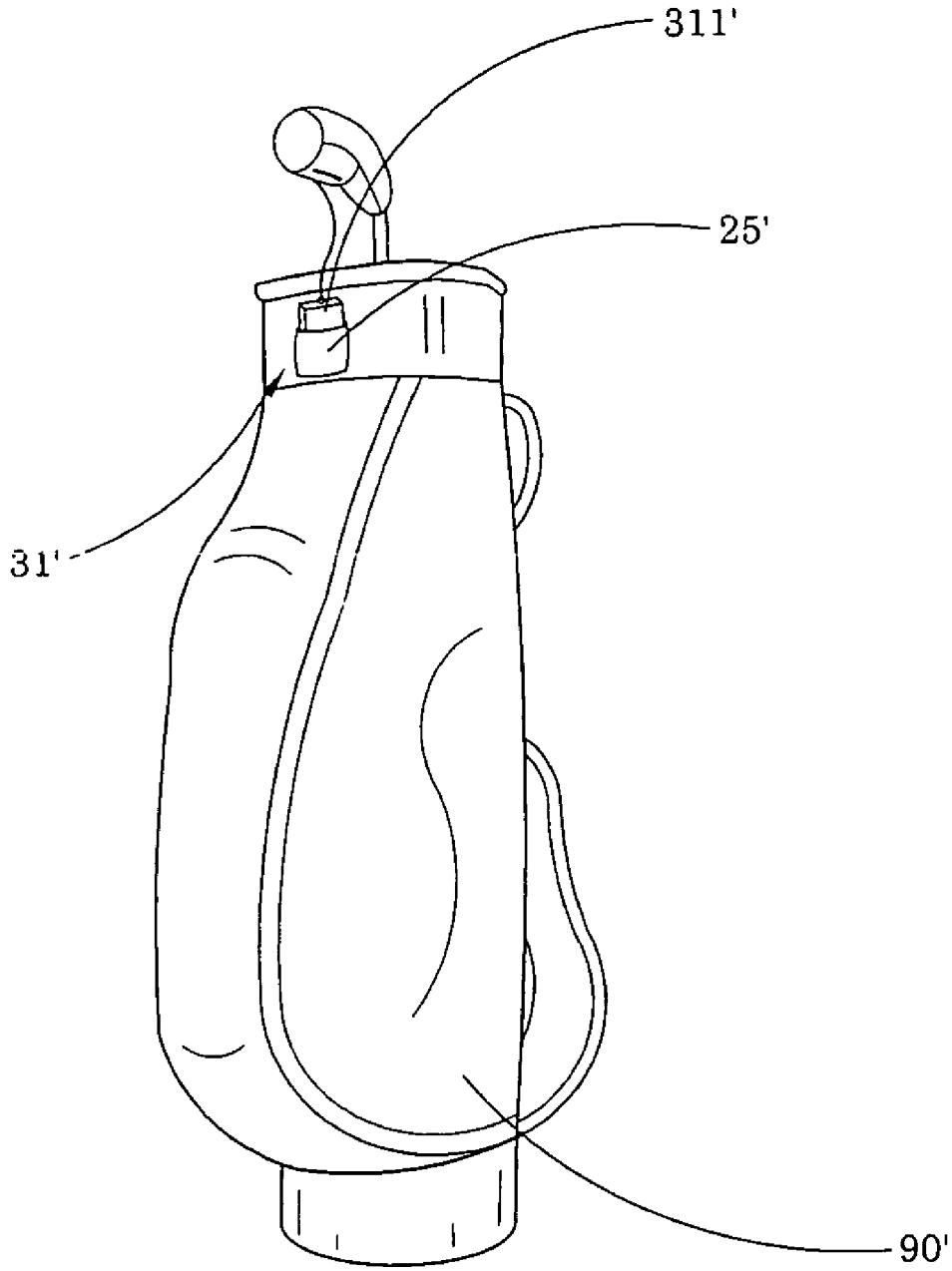
FIG. 9 is a first alternative mode of the golf club head cover according to the above preferred embodiment of the present invention.

Referring to FIG. 9 of the drawings, a first alternative mode of the golf club head cover 10' according to the preferred embodiment of the present invention is illustrated. The first alternative mode is similar to the preferred embodiment except that the golf club head cover of the present invention is used in conjunction with a golf bag 90'. According to the alternative mode, a golf bag 90 comprises a power source pocket 25' provided on an outer surface thereon wherein the battery rack 311' of the power source 31' and the control switch 35 are extended from the receiving cavity to dispose in the power source pocket 25', so that a user is able conveniently replace the batteries 312 and control the operation of the heating plate 33 without accessing the receiving cavity 21. Moreover, a size of the receiving cavity 21 can also be minimized because the battery rack 311' and the batteries 312 are no longer disposed within the receiving cavity 21. Finally, it is worth mentioning that control switch 35 may be provided at any position of the golf bag 90 so that the present invention can be used in a wide range of situations and for different kinds of users. The experimental results of the golf club head cover for various working conditions and time are shown as follows, where time is period over which the heating plate is heated with a predetermined current, HPT stands for temperature of the heat plate 33, and GT stands for temperature of the gold club head.

TABLE 1

| Time (min) | HPT (° C.) | GT (° C.) |
|---|---|---|
| 0:02 | 37 | 18 |
| 0:04 | 40 | 20 |
| 0:06 | 42 | 21 |
| 0:08 | 44 | 23 |
| 0:10 | 45 | 24 |
| 0:12 | 46 | 25 |
| 0:14 | 47 | 26 |
| 0:16 | 49 | 27 |
| 0:18 | 49 | 28 |
| 0:20 | 50 | 29 |
| 0:22 | 51 | 30 |
| 0:24 | 52 | 31 |
| 0:26 | 53 | 32 |
| 0:28 | 53 | 32 |
| 0:30 | 54 | 33 |
| 0:32 | 54 | 34 |
| 0:34 | 55 | 35 |
| 0:36 | 56 | 35 |
| 0:38 | 56 | 36 |
| 0:40 | 57 | 36 |
| 0:42 | 57 | 37 |
| 0:44 | 58 | 38 |
| 0:46 | 59 | 38 |
| 0:48 | 60 | 39 |
| 0:50 | 60 | 39 |
| 0:52 | 60 | 40 |
| 0:54 | 60 | 40 |
| 0:56 | 61 | 41 |
| 0:58 | 61 | 41 |
| 1:00 | 61 | 42 |
| 1:02 | 61 | 42 |
| 1:04 | 62 | 42 |
| 1:06 | 62 | 43 |
| 1:08 | 62 | 43 |
| 1:10 | 62 | 44 |
| 1:12 | 63 | 44 |
| 1:14 | 63 | 44 |
| 1:16 | 63 | 45 |
| 1:18 | 64 | 45 |
| 1:20 | 64 | 45 |
| 1:22 | 64 | 46 |
| 1:24 | 64 | 46 |
| | HPT(38° C.) | |
| 1:26 | 64 | 46 |
| 1:28 | 65 | 46 |

TABLE 1-continued

| Time (min) | | GT (° C.) |
|---|---|---|
| 1:30 | 65 | 47 |
| 1:32 | 65 | 47 |
| 1:34 | 65 | 47 |
| 1:36 | 65 | 47 |
| 1:38 | 66 | 48 |
| 1:40 | 66 | 48 |
| 1:42 | 66 | 48 |
| 1:44 | 66 | 48 |
| 1:46 | 66 | 48 |
| 1:48 | 66 | 49 |
| 1:50 | 66 | 49 |
| 1:52 | 66 | 49 |
| 1:54 | 67 | 49 |
| 1:56 | 67 | 49 |
| 1:58 | 67 | 49 |
| 2:00 | 67 | 49 |
| 2:02 | 67 | 50 |
| 2:04 | 67 | 50 |
| 2:06 | 67 | 50 |
| 2:08 | 68 | 50 |
| 2:10 | 68 | 50 |
| 2:12 | 69 | 50 |
| 2:14 | 69 | 50 |
| 2:16 | 69 | 50 |
| 2:18 | 69 | 50 |
| 2:20 | 69 | 50 |
| | HPT(4466° C.) | |
| 2:22 | 69 | 50 |
| 2:24 | 69 | 50 |
| 2:26 | 69 | 50 |
| 2:28 | 69 | 50 |
| 2:30 | 69 | 50 |
| 2:32 | 69 | 50 |
| 2:34 | 69 | 50 |
| 2:36 | 69 | 50 |
| 2:38 | 69 | 50 |
| 2:40 | 70 | 50 |
| 2:42 | 70 | 50 |
| 2:44 | 70 | 50 |
| 2:46 | 70 | 50 |
| 2:48 | 70 | 50 |
| 2:50 | 70 | 50 |
| 2:52 | 70 | 50 |
| 2:54 | 70 | 50 |
| 2:56 | 70 | 50 |

Table 2 illustrates the heating of the golf club head with high temperature, where time is period over which the heating plate is heated with a predetermined current, HPT stands for temperature of the heat plate 33, and GT stands for temperature of the gold club head.

TABLE 2

| Time (min) | HPT (° C.) | GT (° C.) |
|---|---|---|
| 0:02 | 78 | 29 |
| 0:04 | 78 | 36 |
| 0:06 | 88 | 42 |
| 0:08 | 88 | 46 |
| 0:10 | 89 | 51 |
| 0:12 | 90 | 54 |
| 0:14 | 91 | 56 |
| 0:16 | 92 | 58 |
| 0:18 | 93 | 60 |
| 0:20 | 94 | 62 |
| 0:22 | 95 | 64 |
| 0:24 | 96 | 66 |
| 0:26 | 97 | 67 |
| 0:28 | 98 | 69 |
| 0:30 | 100 | 70 |
| 0:32 | 100 | 72 |
| 0:34 | 101 | 73 |
| 0:36 | 102 | 74 |

TABLE 2-continued

| Time (min) | HPT (° C.) | GT (° C.) |
|---|---|---|
| 0:38 | 104 | 75 |
| 0:40 | 104 | 76 |
| 0:42 | 105 | 77 |
| 0.44 | 106 | 78 |

Figure 10:
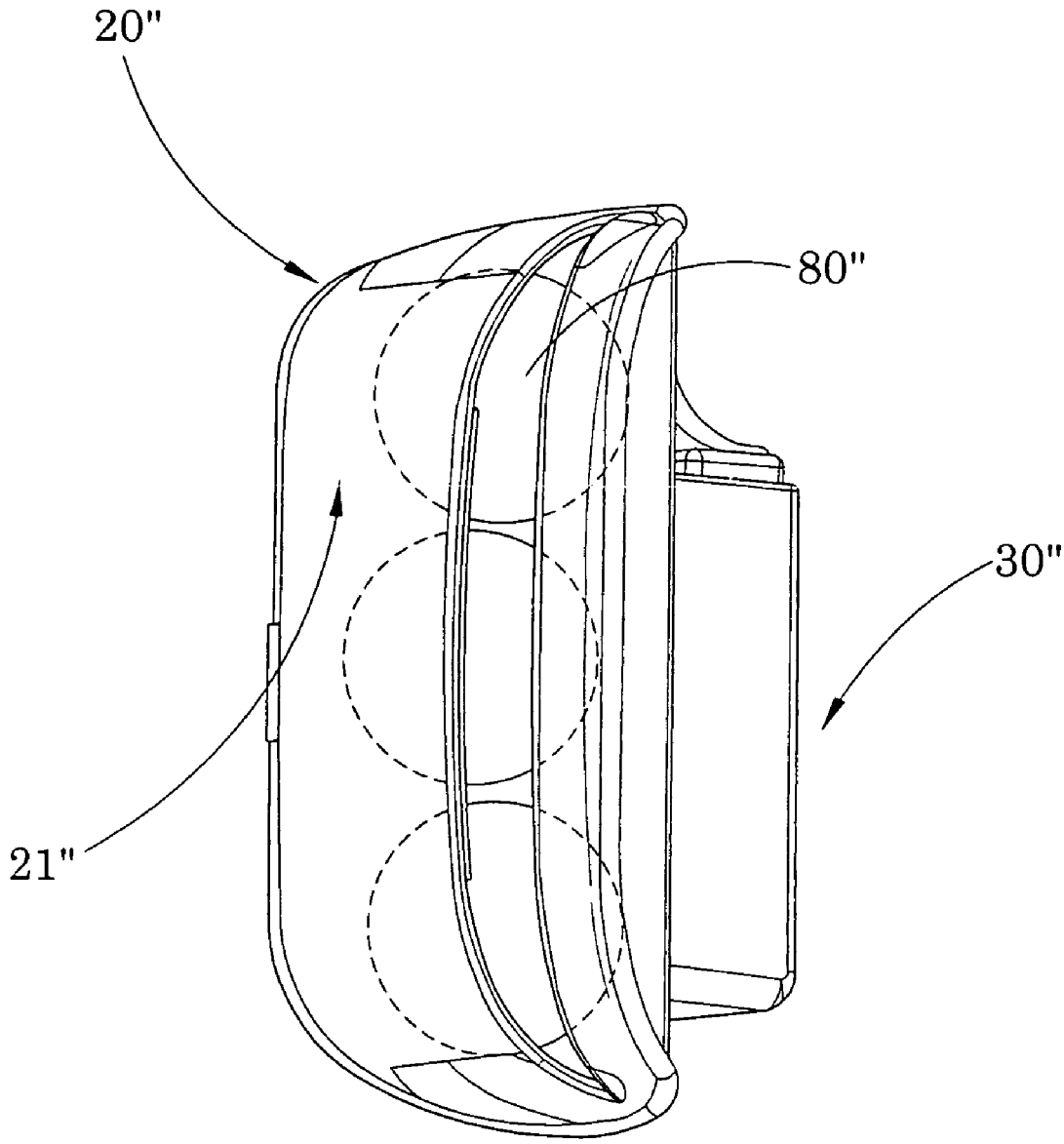
FIG. 10 is a perspective view of a second alternative mode of the golf club head cover according to the above preferred embodiment of the present invention.
Figure 11:
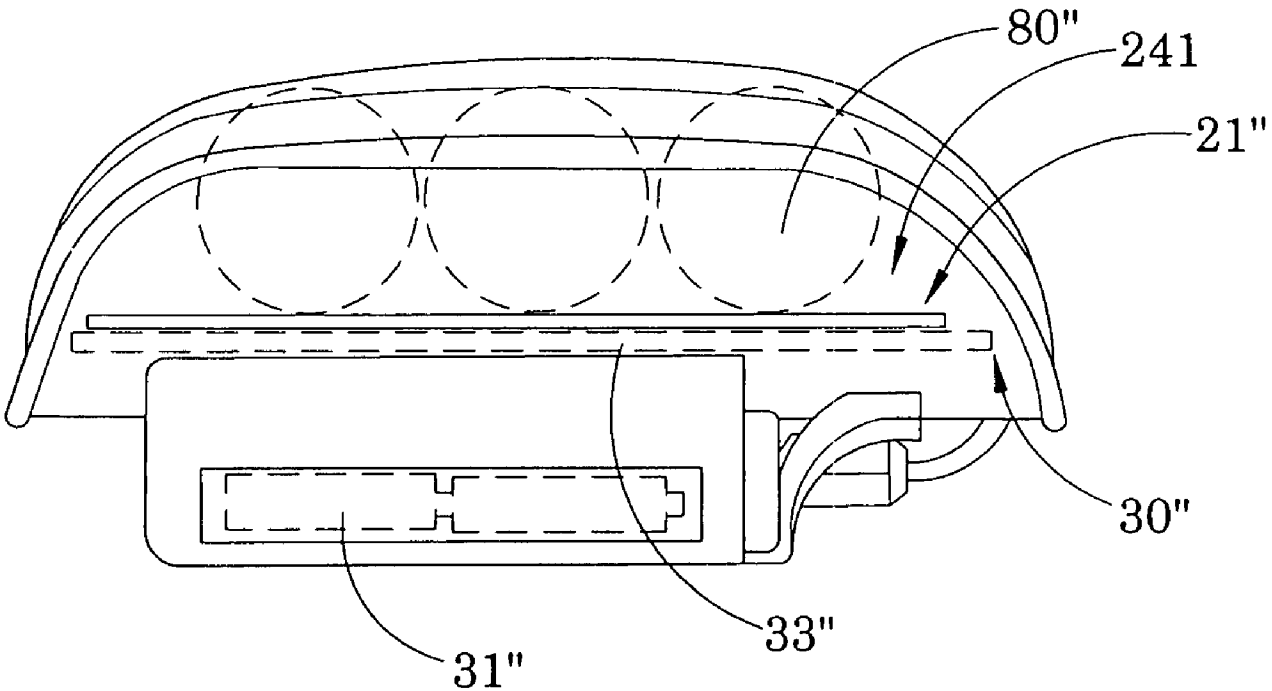
FIG. 11 is a schematic diagram of a second alternative mode of the golf club head cover according to the above preferred embodiment of the present invention.

Referring to FIG. 10 to FIG. 11 of the drawings, a second alternative mode of the gold club head cover according to the preferred embodiment of the present invention is illustrated. The second alternative mode is similar to the preferred embodiment except that the golf club head cover can also be embodied for containing and gently heating golf balls 80". More specifically, the receiving cavity 21" of the main housing 20" is adapted to receive a predetermined number of golf balls 80", wherein the temperature controlling device 30" is disposed within the receiving cavity 21" for heating the golf balls 80". Thus, the heating plate 33" and the power source 31" are disposed at a lower portion of the receiving cavity 21" while the predetermined number of golf balls 80" is disposed in the receiving cavity 21" to thermally communicate with the heating plate 33". When the power source 31" is activated, the heating plate 33" is arranged to be heated up by the power source 31", wherein the heat generated by the heating plate 33" is transferred to the golf ball 80" through the heating pocket 24" so as to heat up and maintain the golf ball 80" at an predetermined elevated temperature for achieving an optimal performance when the golf ball 80" is being hit.

Figure 12:
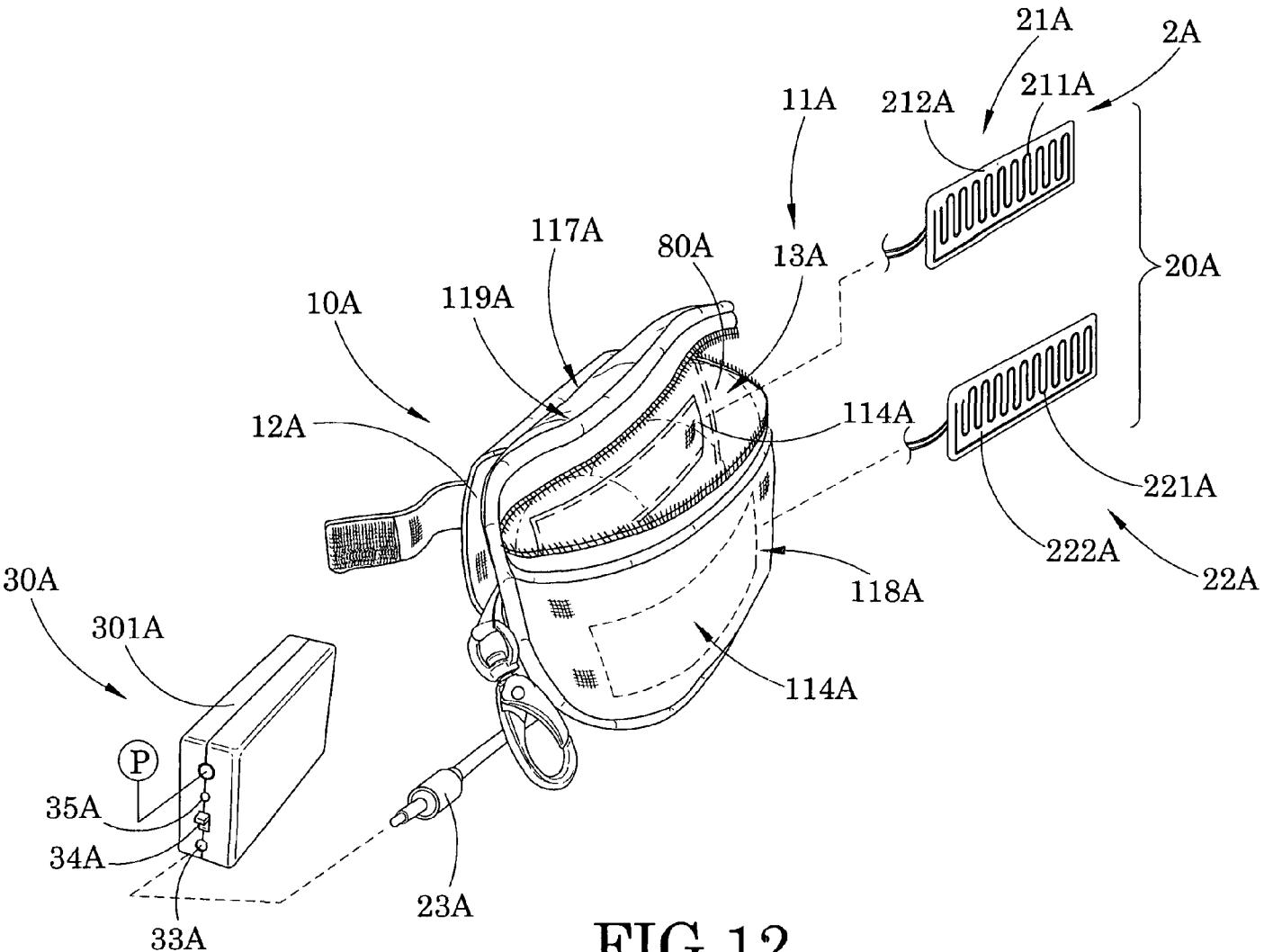
FIG. 12 is a perspective view of the golf ball bag according to a second preferred embodiment of the present invention.
Figure 13:
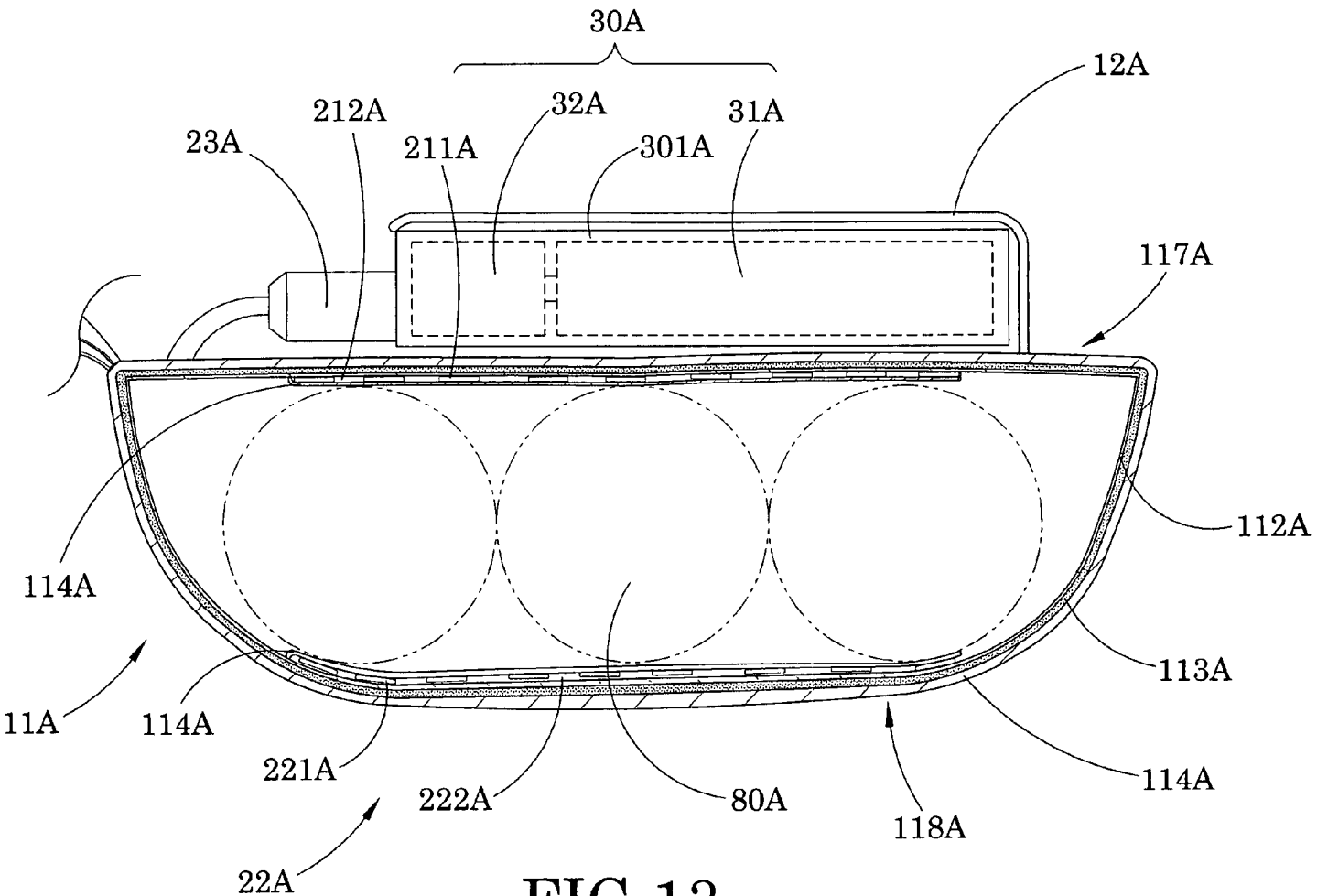
FIG. 13 is a sectional view of the golf ball bag according to the above second preferred embodiment of the present invention.

Referring to FIGS. 12 and 13 of the drawings, the present invention further provides a golf ball bag of a second preferred embodiment of the present invention as another golf accessory to heat up and maintain the golf balls 80A at a predetermined elevated temperature for achieving an optimal performance when the golf ball 80A is being hit.

According to the second embodiment, the golf ball bag comprise a main housing 10A having a receiving cavity 13A for receiving one or more golf balls 80A therein, and a temperature controlling device 2A to control the temperature of the hitting surface of each of the golf balls 80A.

As shown in FIGS. 12 and 13, the temperature controlling device 2A comprises a heating device 20A supported in the receiving cavity 13A of the main housing 10A, and a power source 30A electrically coupling with the heating device 20A, wherein when the power source 30A is activated, the heating device 20A generates heat towards the golf balls 80A to maintain the hitting surface of each of the golf balls 80A at an optimal hitting temperature for optimal performance thereof.

Accordingly, the heating device 20A comprises a first heating plate 21A which is longitudinally aligned at a rear wall of the receiving cavity 13A and is electrically coupled with the power source 30A for heat generation within the receiving cavity 13A. The heating device 20A further comprises a second heating plate 22A which is longitudinally aligned at a front wall of the receiving cavity 13A and is electrically coupled with the power source 30A for heat generation within the receiving cavity 13A, such that the golf balls 80A are longitudinally received the receiving cavity 13A and sandwiched between the first and second heating plates 21A, 22A. In other words, when the golf balls 80A are received in the receiving cavity 13A of the main housing 10A, two corresponding portions of each of the golf balls 80A are contacted with the first and second heating plates 21A, 22A.

As shown in FIG. 12, each of the first and second heating plates 21A, 22A comprise an elongated flexible heating element 211A, 221A which is made of heat conductive material and is bent in a zigzag configuration for maximizing a heat-generating area, and a heat transferring sleeve 212A, 222A receiving the flexible heating element 211A, 221A for evenly disturbing the heat from the flexible heating element 211A, 221A to the receiving cavity 13A in a planar direction, such that the heating plates 21A, 22A can be flexibly bent to fit the shape of golf balls 80A to have relatively better contact between the heating plates 21A, 22A and the hitting surfaces of the golf balls 80A so as to maintain the accurate temperature of the hitting surfaces of the golf balls 80A. It is worth to mention that since the heating element 211A, 221A is flexible and is bent in zigzag configuration, the heat transferring sleeve 212A, 222A not only protects the heating element 211A, 221A from being broken but also enhances the heat distributing towards the receiving cavity 13A evenly.

The power source 30A, which is portable power supply, comprises a rechargeable battery 31A and a control circuit 32A electrically connected to the rechargeable battery 31A to operatively control the heating device 20A for heat generation for promptly and accurately responding to a temperature deficiency of the hitting surfaces 51A of the golf balls from the optimal hitting temperature. The power source 30A further comprises a casing 301A, wherein the rechargeable battery 31A and the control circuit 32A are protectively received in the casing 301A.

Accordingly, the power source 30A further comprises a control switch 34A electrically connected to the control circuit 32A for selectively activating the heating device 20A in a controlled manner, a heating indicator 35A electrically coupling with the control circuit 32A for indicating a heating status of the hitting surfaces 51A of the golf balls 80A. The heating indicator 35A comprises a LED light connected to the control circuit 32A to incorporate with the control switch 34A so that to indicate the on-and-off status of the power source 30A.

As shown in FIGS. 12 and 13, the main housing 10A comprises a ball pouch 11A defining the receiving cavity 13A thereat for receiving the golf balls 80A and a power pouch 12A for receiving the power source 30 therein. Therefore, the heating device 20A and the power source 30A are individually disposed in the ball pouch 11A and the power pouch 12A respectively.

According to the preferred embodiment, the ball pouch 11A comprises an outer durable layer 111A, an inner lining layer 112A, and an intermediate heat insulating layer 113A sandwiched between the durable layer 111A and the lining layer 112A for maintaining the hitting temperature within the receiving cavity 13A of the ball pouch 11A. It is appreciated that the separated ball pouch 11A and power pouch 12A is adapted for separating the receiving cavity 13A within the ball pouch 11A and the power source 30A received in the power pouch 12A by the outer, inner, and intermediate layers 111A, 112A, 113A within the rear panel 117A of the ball pouch 11A, so that can prevent the power source 30A to be heated, such that the golf balls 80A are relatively easier to be taken. In addition, the heat insulating layer 113A of the ball pouch 11A not only forms a heat insulation wall to prevent heat loss within the receiving cavity 13A but also functions as a heat blocking wall to prevent the heat transferring from the receiving cavity 13A to the power pouch 12A to damage the power source 30A.

Accordingly, the ball pouch 11A further comprises two heating pockets 114A provided at the front wall and the rear wall of the receiving cavity 13A respectively, wherein each of the heating pockets 114A has a side opening for slidably receiving the corresponding first and second heating plates 21A, so as to ensure the hitting surfaces of the golf balls 80A being contacted between the first and second heating plates 21A, 22A at the same time.

It is appreciated that the ball pouch 11A has a rear panel 117A, a front panel 118A, and a top panel 119A defining the receiving cavity 13A within the rear, the front, and the top panel 117A, 118A, 119A, wherein the top panel 119A having a top opening such as a zip is adapted for easily accessing each golf balls so that the golf balls can be longitudinally put into the receiving cavity 13A for user to select the golf balls. It is worth to mention that the receiving cavity 13A is adapted for receiving at least two golf balls, so that when one golf ball is missing, there's always another warmed golf ball ready for being hit.

The heating device 20A further comprises an electrical plug 23A extending out of the rear wall of the receiving cavity 13A to detachably connect to an electrical terminal 33A of the power source 30A, such that the power source 30A is adapted to remove from the power pouch 12A for charging purpose, and is adapted to receive in the power pouch 12A to electrically couple with the heating device 20A by the heating device 20A coupling with the electrical plug 23A when the electrical plug 22A is engaged with the electrical terminal 33A of the power source 30A. In addition, the electrical plug 23A is electrically extended from the first and second heating plates 21A, 22A through a space between the outer layer 111A and the heat insulating layer 113A such that the heat within the receiving cavity 13A is blocked by the heat insulating layer 113A to protect the wiring structure between the electrical plug 23A and the heating plates 21A, 22A.

It is worth to mention that the golf ball bag further has a hook for detachably engaging with the golf club bag, so that the user can simply incorporate the golf club bag with the golf ball bag.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A golf ball bag, comprising:

a main housing having a receiving cavity for receiving one or more golf balls therein; and a temperature controlling device, which comprises:

a heating device supported in said receiving cavity of said main housing, wherein said heating device comprises a first heating plate which is longitudinally aligned at a rear wall of said receiving cavity, and a second heating plate which is longitudinally aligned at a front wall of said receiving cavity; and a power source electrically coupling with said heating device, wherein when said power source is activated, said heating device generates heat towards said golf balls to maintain a hitting surface of each of said golf balls at an optimal hitting temperature for optimal performance thereof, wherein said first heating plate is electrically coupled with said power source for heat generation within said receiving cavity, wherein said second heating plate is electrically coupled with said power source for heat generation within said receiving cavity, such that said golf balls are longitudinally received said receiving cavity and sandwiched between said first and second heating plates, wherein each of said first and second heating plates comprises an elongated flexible heating element which is made of heat conductive material and is bent in a zigzag configuration for maximizing a heat-generating area, and a heat transferring sleeve receiving said flexible heating element for evenly disturbing said heat from said flexible heating element to said receiving cavity in a planar direction.

2. The golf ball bag, as recited in claim 1, wherein said main housing comprises a ball pouch defining said receiving cavity thereat to receive said golf balls, and a power pouch provided at a rear panel of said ball pouch as an individual compartment to receive said power source in said power pouch, such that said heating device and said power source are individually received in said ball pouch and said power pouch respectively for isolating said heat of said heating device from said power source.

3. The golf ball bag, as recited in claim 2, wherein said ball pouch comprises an outer durable layer, an inner lining layer, and an intermediate heat insulating layer sandwiched between said durable layer and said lining layer for maintaining said hitting temperature within said receiving cavity of said ball pouch.

4. The golf ball bag, as recited in claim 2, wherein said ball pouch comprises two heating pockets provided at said front and rear walls of said receiving cavity to slidably receive said second and first heating plates respectively for ensuring said hitting surfaces of said golf ball being contacted between said first and second heating plates at the same time.

5. The golf ball bag, as recited in claim 3, wherein said ball pouch comprises two heating pockets provided at said front and rear walls of said receiving cavity to slidably receive said second and first heating plates respectively for ensuring said hitting surfaces of said golf ball being contacted between said first and second heating plates at the same time.

6. The golf ball bag, as recited in claim 2, wherein said power source, which is embodied as a portable power supply, comprises a rechargeable battery and a control circuit electrically connected to said rechargeable battery to operatively control said heating device for heat generation for promptly and accurately responding to a temperature deficiency of said hitting surfaces of said golf balls from said optimal hitting temperature.

7. The golf ball bag, as recited in claim 5, wherein said power source, which is embodied as a portable power supply, comprises a rechargeable battery and a control circuit electrically connected to said rechargeable battery to operatively control said heating device for heat generation for promptly and accurately responding to a temperature deficiency of said hitting surfaces of said golf balls from said optimal hitting temperature.

8. The golf ball bag, as recited in claim 6, wherein said heating device further comprises an electrical plug extending out of said rear wall of said ball pouch to detachably connect to an electrical terminal of said power source, such that said power source is adapted to remove from said power pouch for charging purpose and is adapted to receive in said power pouch to electrically couple with said heating device when said electrical plug is engaged with said electrical terminal.

9. The golf ball bag, as recited in claim 7, wherein said heating device further comprises an electrical plug extending out of said rear wall of said ball pouch to detachably connect to an electrical terminal of said power source, such that said power source is adapted to remove from said power pouch for charging purpose and is adapted to receive in said power pouch to electrically couple with said heating device when said electrical plug is engaged with said electrical terminal.

10. The golf ball bag, as recited in claim 7, wherein said power source further comprises a control switch electrically connected to said control circuit for selectively activating said heating device in a controlled manner, and a heating indicator electrically coupling with said control circuit for indicating a heating status of said hitting surfaces of said golf balls.

11. The golf ball bag, as recited in claim 9, wherein said power source further comprises a control switch electrically connected to said control circuit for selectively activating said heating device in a controlled manner, and a heating indicator electrically coupling with said control circuit for indicating a heating status of said hitting surfaces of said golf balls.

12. A golf ball bag, comprising:

a main housing having a receiving cavity for receiving one or more golf balls therein, wherein said main housing comprises a ball pouch defining said receiving cavity thereat to receive said golf balls and a power pouch provided at a rear panel of said ball pouch as an individual compartment; and a temperature controlling device, which comprises:

a heating device supported in said receiving cavity of said main housing; and a power source electrically coupling with said heating device, wherein when said power source is activated, said heating device generates heat towards said golf balls to maintain a hitting surface of each of said golf balls at an optimal hitting temperature for optimal performance thereof, wherein said power pouch provided at said rear panel of said ball pouch as said individual compartment receives said power source in said power pouch, such that said heating device and said power source are individually received in said ball pouch and said power pouch respectively for isolating said heat of said heating device from said power source.

13. The golf ball bag, as recited in claim 12, wherein said ball pouch comprises an outer durable layer, an inner lining layer, and an intermediate heat insulating layer sandwiched between said durable layer and said lining layer for maintaining said hitting temperature within said receiving cavity of said ball pouch.

14. A golf ball bag, comprising:

a main housing having a receiving cavity for receiving one or more golf balls therein, wherein said main housing comprises a ball pouch defining said receiving cavity thereat to receive said golf balls, and a power pouch provided at a rear panel of said ball pouch as an individual compartment; and a temperature controlling device, which comprises:

a heating device supported in said receiving cavity of said main housing, wherein said heating device comprises a first heating plate which is longitudinally aligned at a rear wall of said receiving cavity and a second heating plate which is longitudinally aligned at a front wall of said receiving cavity; and a power source electrically coupling with said heating device, wherein when said power source is activated, said heating device generates heat towards said golf balls to maintain a hitting surface of each of said golf balls at an optimal hitting temperature for optimal performance thereof, wherein said first heating plate is electrically coupled with said power source for heat generation within said receiving cavity, and said second heating plate is electrically coupled with said power source for heat generation within said receiving cavity, such that said golf balls are longitudinally received said receiving cavity and sandwiched between said first and second heating plates, wherein said power pouch provided at said rear panel of said ball pouch as said individual compartment receives said power source in said power pouch, such that said heating device and said power source are individually received in said ball pouch and said power pouch respectively for isolating said heat of said heating device from said power source.

15. The golf ball bag, as recited in claim 14, wherein said ball pouch comprises an outer durable layer, an inner lining layer, and an intermediate heat insulating layer sandwiched between said durable layer and said lining layer for maintaining said hitting temperature within said receiving cavity of said ball pouch.

* * * * *